US006811623B2

(12) United States Patent
Boegel et al.

(10) Patent No.: US 6,811,623 B2
(45) Date of Patent: Nov. 2, 2004

(54) COPPER-NICKEL-MANGANESE ALLOY, PRODUCTS MADE THEREFROM AND METHOD OF MANUFACTURE OF PRODUCTS THEREFROM

(75) Inventors: Andreas Boegel, Weissenhorn (DE); Klaus Ohla, Illerkirchberg (DE); Hilmar R. Mueller, Bellenberg (DE)

(73) Assignee: Wieland-Werke AG, Ulm (DE)

( * ) Notice: Subject to any disclaimer, the term of this patent is extended or adjusted under 35 U.S.C. 154(b) by 113 days.

(21) Appl. No.: 10/125,314

(22) Filed: Apr. 18, 2002

(65) Prior Publication Data

US 2003/0007884 A1 Jan. 9, 2003

(30) Foreign Application Priority Data

Apr. 19, 2001 (EP) ..... 01109659

(51) Int. Cl.[7] ..... C22C 9/06
(52) U.S. Cl. ..... 148/435; 420/487
(58) Field of Search ..... 148/435; 420/487

(56) References Cited

U.S. PATENT DOCUMENTS 2,234,552 A 3/1941 Dean et al.

FOREIGN PATENT DOCUMENTS

| | | | |
|---|---|---|---|
| DE | 196 00 864 | | 7/1997 |
| EP | 0 225 080 | | 6/1987 |
| EP | 0 225 732 | | 6/1987 |
| GB | 577 170 | | 5/1946 |
| GB | 1 379 261 | | 1/1975 |
| GB | 1 553 056 | | 9/1979 |
| GB | 1 599 392 | | 9/1981 |
| JP | 62-202038 | | 9/1987 |
| JP | 62202038 | * | 9/1987 |
| JP | 3-99750 | | 4/1991 |

OTHER PUBLICATIONS

Vinogradov, V.N.;Korotkov,V.A.;Obishchenko, L.N.; Perosyants, A.A., Composite material as an important reserve for increasin the life of gas and petroleum equipment, Trenie i Iznos (1982), 3(3), 428–35. (Provided with abstract only).*

Specification for Rotary Drill Stem Elements, API Specification 7 (Spec 7); Apr. 1, 1994 by American Petroleum Institute (pp. 20–25).

* cited by examiner

*Primary Examiner*—Sikyin Ip
(74) *Attorney, Agent, or Firm*—Flynn, Thiel, Boutell & Tanis, P.C.

(57) ABSTRACT

A Cu-Ni-Mn alloy which consists of 15 to 25% Ni; 15 to 25% Mn; 0.001 to 1.0% of a chip-breaking additive (lead, carbon, etc.), the remainder being copper and common impurities. The alloy can preferably be used as a replacement material for Be-containing copper materials for the manufacture of disconnectable electrical connections or for the manufacture of tools and components for the offshore field and the mining industry.

11 Claims, No Drawings

COPPER-NICKEL-MANGANESE ALLOY, PRODUCTS MADE THEREFROM AND METHOD OF MANUFACTURE OF PRODUCTS THEREFROM

FIELD OF THE INVENTION

The invention relates to a copper-nickel-manganese alloy and its use as a material, in particular, for the manufacture of disconnectable electrical connections and of tools and components in the offshore field and the mining industry.

BACKGROUND OF THE INVENTION

It is known to replace relatively expensive copper-beryllium alloys with low priced copper-nickel-manganese alloys, for example, in the field of electrical and electronic components.

As environmental concerns become increasingly stronger, viewpoints regarding environmental friendliness and health hazards move increasingly to the center of interest. Any type of criticism must be avoided.

Due to possible health hazardous effects of Be dusts and vapors, which can occur during improper working of Be-containing materials, the demand for Be-free materials therefore increases.

SUMMARY OF THE INVENTION

Therefore, the basic purpose of the invention is to make available a further (Be-free) Cu—Ni—Mn alloy with partly better characteristics.

The purpose is attained according to the invention by providing a Cu—Ni—Mn alloy, which consists of 15 to 25% nickel; 15 to 25% manganese; 0.001 to 1.0% of a chip-breaking additive, the remainder being copper and the usual impurities (the percentage information relates thereby to the weight).

As chip-breaking additives one can thereby consider preferably lead, carbon, in particular in the form of graphite or soot particles, and intermetallic phases. The intermetallic phases are thereby formed by the addition of at least one element from the group of phosphorus, silicon, titanium, vanadium and sulphur.

From JP-OS 62–202,038 is indeed known a Cu—Ni—Mn alloy with 5 to 35% nickel, 5 to 35% manganese, which in addition contains 0.01 to 20% of one or several elements, which can be selected from two groups of a plurality of elements, among them also lead. Compared with this the claimed alloy composition provides a choice; because the claimed ranges are narrow compared with the abundance of variation possibilities according to the state of the art. The claimed ranges are in addition far removed from the examples according to the table of the JP-OS. Furthermore, a calculated choice exists since with the chip-breaking additive to the Cu—Ni—Mn alloy surprisingly an excellent combination of strength and toughness of the alloy is achieved as will be discussed in greater detail later on in particular in connection with one exemplary embodiment.

A particularly homogeneous distribution with little segregation of all alloy elements exists when the alloy of the invention is manufactured according to the spray-forming method.

The original forming process for the copper material occurs through spray-forming (compare the so-called "OSPREY" process, for example, according to the GB Patents 1,379,261/1,599,392 or EP Patent 0,225,732). Bolts can be used as the blank, which bolts are processed through typical hot forming methods (pressing, rolling, forging) into semifinished products (rods, tubes, profiles, sleeves).

The alloy of the invention can be used preferably as a material for the manufacture of disconnectable electrical connections, in particular pin-and-socket connections or the like since it meets the demanded characteristic profile because pin-and-socket connectors out of copper materials must have the following characteristics:

1. High Mechanical Strength:
   Pin-and-socket connector materials must generally have a high strength (high yield strength and high hardness) since plugging and unplugging operations may result in nonpermissible deformations of the plug.
2. Good Flexibility:
   The manufacture of complex components occurs today mostly on fully automated multi-spindle automatic machines. The parts are manufactured in such a manner that, in contrast to strips, bending operations are not needed. Therefore no demands regarding the flexibility of the material exist.
3. Good Spring Characteristics:
   Pin-and-socket connectors must when in use guarantee a perfect signal transfer. A good contact, even after repeated plugging and unplugging operations, must be maintained. In order for the springy effect to be maintained even after repeated plugging and unplugging operations, the material must have an as high as possible spring bending limit.
4. Stress Relaxation:
   Plug-and-socket connectors are used at various temperature ranges. The temperature increase results from the surrounding heat (for example, due to the proximity to connecting machines) and/or self heating during current passage due to the inner resistance. With respect to the importance of the stress relaxation reference is made to our DE-PS 196 00 864.
5. Corrosion Resistance:
   Pin-and-socket connectors are, aside from varying temperature ranges, also subjected to many different atmospheres. The corrosion resistance must exist in general (for example the addition of nickel).
6. Galvanizing Ability:
   Pin-and-socket connectors are usually coated with gold, silver, nickel and other materials. The applied coat must have a good adhesion to the submaterial.
7. Permeability:
   Components in the high-frequency engineering may not have any magnetic characteristics since otherwise signal distortions (for example, intermodulation distortions) can occur. Many pin-and-socket connectors are made out of brass, which is (slightly ferromagnetic) gold-plates through an in-between layer of nickel. The coating is electrolytically applied. The thereby created nickel crystals are according to experience so small that there is no electromagnetic polarization or only an insignificant amount.

The copper-nickel-manganese-lead variation manufactured via the spray-forming method is very fine grained in the casting stage. The method moreover guarantees a homogeneous nickel distribution. Zones are created during conventional manufacture, which zones are enriched with nickel. These grain segregations do not fully dissolve according to experience during the further manufacture so that the HF-capability is not given or is only given to a limited extent.

This lead-containing variation has a fine lead distribution and can be easily machined.

The good characteristic combination of the Cu—Ni—Mn alloy of the invention permits in addition also an advantageous use as a material for the manufacture of tools and components for the offshore field and the mining industry, in particular for drilling installations.

Mechanical components (as for example drilling rods, screw couplings, bolts, etc.) are demanded for high stress situations in offshore engineering, which components must have a high capacitance and may neither be ferromagnetic nor may they cause explosions or fire during impacting one another through pyrophorous reactions of flying fragments. Components and tools out of Cu-Be alloys, which unite these characteristics in a particular manner, are utilized according to the state of the art for such demands. It has now been found surprisingly that with Cu—Ni—Mn alloys of the suggested Be-free composition not only all demands can be met but also considerable advantages in the availability compared with the common Cu-Be alloys are achieved and when combined with the manufacture through spray-forming, a selectively better technological suitability is found, in particular, the demands for drill string components according to the API (American Petroleum Institute) Specification 7 ("Specification for Rotary Drill Stem Elements") $38^{th}$ Ed., Apr. 1, 1994, are met.

The following specific characteristics are demanded for copper materials in this field.

1. Magnetic Characteristics:

In order to meet metrological demands of the drill string in the area of compass measuring systems (measuring the Earth's magnetic field and direction information, which can be derived therefrom) drill string components must be nonmagnetic in this area since in the presence of magnetic materials faulty measurements due to the influence of the magnetic field occur. The magnetic susceptibility X should accordingly not exceed $20 \cdot 10^{-6}$. (X indicates thereby according to the Equation $\vec{M} = \mu_o \cdot X \cdot \vec{H}$ the relationship of the magnetization $$\vec{M}\left[\frac{V_s}{m^2}\right]$$

with respect to the magnetic field strength $$\vec{H}\left[\frac{A}{m}\right],$$

with $$\mu_o = 4\Pi \cdot 10^{-7} = 1.256 \cdot 10^{-6}\left[\frac{V_s}{Am}\right]$$

as magnetic field constant.)

2. Yield Strength/Hardness:

The drill string is subjected to high mechanical and physical/chemical stress. The individual string elements are connected with one another by threaded connections. Due to the high forces which occur in the drill hole, the individual string elements are screwed together by applying high torques. In order to avoid plastic deformations of the threads, the material must have a high yield strength. The drill string surfaces are stressed by abrasion and erosion. The wear is reduced to a minimum by an as high as possible material hardness.

3. Toughness:

The exact stress collectives are as a rule unknown. However, tests on damages, which have occurred, have shown that very high vibration and sudden stresses can occur. The toughness of the materials being utilized therefore plays a decisive role for the safe functioning. The toughness of the copper alloy being utilized should therefore be maximized for a strength level and should as much as possible be even over the cross section.

4. Corrosion Resistance:

The rock formations are mechanically destroyed at the bottom of the drill hole and are pumped to the surface by a so-called drill flushing. Increased temperature and the chemical or physical-chemical attack by the drilling fluid demand a high corrosion resistance of the materials being used. The material must, in particular in sulphur-containing media, be resistant to stress corrosion cracking.

5. Galling:

The screwed connection of the individual drill-string elements under high torque may result in a cold welding ("galling"). Therefore heterogeneous materials (for example, steel with NE-metal) are as much as possible supposed to be connected with one another. Therefore intermediate pieces out of a high-strength copper alloy are often screwed in-between in the case of thread connections of drill-string components out of austenitic, nonmagnetizable steels. For example, copper-beryllium (UNS C 17200) was used up to now as a suitable copper material. As an example, the copper-beryllium intermediate pieces, which are used for austenitic, nonmagnetizable drill stems (so-called "drill collars"), apply here.

Exemplary Embodiment:

The following table compares especially the mechanical characteristics of an alloy of the invention CuNi20Mn20Pb0.05 (spray-formed) with a CuBe2 alloy. Rods, manufactured by spray forming, extruding and drawing up to 50% cold-working, annealed, were used as samples. The comparison data for CuBe2 alloy were taken from relevant literature.

| Alloy | Yield Strength $R_{p\ 0.2}$[MPa] | Tensile Strength $R_m$[MPa] | Elongation A5[%] | Vicker Hardness HV | Electric Conductivity % IACS |
|---|---|---|---|---|---|
| CuNi20Mn20Pb0.05 | 1000–1300 | 1100–1400 | 1–6 | to 370 | to 2.5 |
| CuBe2 | to 1400 | to 1500 | 1–6 | to 430 | to 25 |

This shows that with the alloy of the invention an excellent copper-replacement material compared with the CuBe alloys is available.

What is claimed is:

1. A spray-compacted copper-nickel-manganese alloy having a homogeneous distribution with little segregation of all alloy elements existing and having a medium grain size $D_k$=50–70$\mu$m, said alloy consisting of 15–25% nickel, 15–25% manganese, 0.001–1.0% of a chip-breaking additive, the remainder being copper and common impurities.

2. The copper-nickel-manganese alloy according to claim 1, wherein it contains lead as the chip-breaking additive.

3. The copper-nickel-manganese alloy according to claim l, wherein it contains carbon as the chip-breaking additive.

4. The copper-nickel-manganese alloy according to claim 3, wherein it contains the carbon in the form of graphite particles with a medium grain-size distribution of 0.5 to 1000 $\mu$m.

5. The copper-nickel-manganese alloy according to claim 3, wherein it contains the carbon in the form of soot particles with a medium grain-size distribution of 0.01 to 1500 $\mu$m.

6. The copper-nickel-manganese alloy according to claim 1, wherein it contains intermetallic phases as the chip-breaking additive.

7. The copper-nickel-manganese alloy according to claim 1, wherein it contains 17 to 23% nickel and 17 to 23% manganese.

8. The copper-nickel-manganese alloy according to claim 7, wherein it contains 19.5 to 20.5% nickel and 19.5 to 20.5% manganese.

9. The copper-nickel-manganese alloy according to claim 1, wherein it has with a lead additive of up to a maximum of 1% a fine lead distribution.

10. In a method of manufacturing a pin-and-socket connector, the improvement comprising manufacturing the pin-and-socket connector from the alloy of claim 1.

11. A pin-and-socket connector made of the copper-nickel-manganese alloy according to claim 1.

* * * * *